United States Patent [19]

Hirokawa

[11] Patent Number: 4,725,485

[45] Date of Patent: Feb. 16, 1988

[54] TEXTILE STRUCTURE FOR REINFORCED COMPOSITE MATERIAL

[75] Inventor: Tetsuro Hirokawa, Omihachiman, Japan

[73] Assignee: Shikishima Canvas Kabushiki Kaisha, Osaka, Japan

[21] Appl. No.: 939,510

[22] PCT Filed: Sep. 13, 1985

[86] PCT No.: PCT/JP85/00515

§ 371 Date: Nov. 10, 1986

§ 102(e) Date: Nov. 10, 1986

[87] PCT Pub. No.: WO87/01743

PCT Pub. Date: Mar. 26, 1987

[51] Int. Cl.[4] ..... D03D 3/00; D03D 3/04; D03D 13/08

[52] U.S. Cl. ..... 428/225; 428/240; 428/241; 428/244; 428/245; 428/257; 428/258

[58] Field of Search ..... 428/221, 222, 224, 225, 428/226, 227, 228, 229, 105, 113, 369, 370, 245, 247, 253, 257, 258, 408, 193, 107; 139/408, 409, 410, 411, 412, 413, 414, 415, 384 R

[56] References Cited

U.S. PATENT DOCUMENTS

| | | | |
|---|---|---|---|
| 4,063,684 | 12/1977 | O'Brien et al. | 239/265.11 |
| 4,336,296 | 6/1982 | Fukuta et al. | 428/257 |
| 4,546,032 | 10/1985 | Vasilos | 428/223 |

*Primary Examiner*—Norman Morgenstern
*Assistant Examiner*—Margaret Burke
*Attorney, Agent, or Firm*—Armstrong, Nikaido, Marmelstein & Kubovcik

[57] ABSTRACT

A textile or filamentary structure for a reinforced composite material comprising a first filament (1) which is disposed in multiple turns or convolutions in a first plane (X-Y) without forming a cut, free or exposed end at each turn and then disposed as a subsequent lamination in another parallel filament-disposition plane in which it extends in a path different from the path of filament disposition in said first plane, whereafter it repeats the lamination in successive planes, a second filament (2) sinuously extending in planes (Y-Z) which intersect the planes of disposition of the first filament, without forming a cut, free or exposed end at each turn, and a third filament (3) sinuously extending in successive parallel planes (X-Y) adjacent the laminations of said first filament (1), passing through loops (5) formed by said second filament (2), thereby retaining the same in the body of the structure.

16 Claims, 9 Drawing Figures

TEXTILE STRUCTURE FOR REINFORCED COMPOSITE MATERIAL

TECHNICAL FIELD

The present invention relates to a textile or filamentary (reinforcement) structure or fabric for a reinforced composite material and more particularly it relates to a textile or filamentary reinforcement, bracing or stiffening structure wherein no cut or free filaments ends are exposed at the end surfaces or side edges of the textile or filamentary structure.

BACKGROUND ART

Composite materials reinforced such by textile or filamentary structures such as woven glass fibre fabrics and woven carbon fibre fabrics, have been used for machine parts requiring strength, such as in aircraft, automobiles, railroad vehicles and ships, and as structural building members. Further, composite materials, such as carbon fibre/carbon matrices, grapite fibre/carbon matrices and graphite fibre/graphite matrices, have been used for machine parts requiring heat resistance to above 1000° C.

Such composite materials reinforced by textile or filamentary structures, are light in weight and physically and chemically strong and they are valued for their usefulness in diverse fields.

The strength characteristics of such composite materials (for example, carbon-carbon composite) depend largely on the construction of a textile or filamentary structure incorporated in a matrix as a reinforcing base material, for example, as a woven fabric body. Thus, such textile structures have their constructions selected to maximise their filament content and diversity, as disclosed, for example, in Japanese Patent Application Laid-Open No. 57-176232 and U.S. Pat. No. 3,904,464, in order to increase the strength of the finished or resultant composite materials. These known textile or filamentary structures, however, each have numerous filament ends exposed, typically in their cut state, at the fabric end or side edge surfaces, with the result that, when the textile structure is impregnated with thermosetting resin, filaments become dislodged, leading to the textile or filamentary structure losing its shape. It may thus be necessary to apply a subsequent mechanical cutting operation to the mis-shaped portion, after the setting of the resin, in order to remove that mis-shapen portion, which severely undermines both the economy of usage of sources or ingredient material and production.

Furthermore, the production of a composite material which is complicated in shape poses another problem, namely that of the strength being decreased owing to the shape or contour involved.

SUMMARY OF THE INVENTION

According to the invention there is provided a textile or filamentary structure comprising a first filament which is disposed in multiple turns or convolutious in a first plane without forming a cut, free or exposed end at each turn and then disposed as a subsequent lamination in another parallel filament-disposition plane in which it extends in a direction different from the direction of filament disposition in the first plane, whereafter it repeats the lamination in successive planes, a second filament sinuously extending in planes which intersect the planes of disposition of the first filament, without forming a cut, free or exposed end at each turn, and third filament which is disposed adjacent the planar laminations of the first filament and sinuously extends through the loops of the second filament thereby retaining the same in the body of the structure.

Such a textile structure according to the invention affords a structure wherein no ends of filaments constituting the base material are exposed at the surface of a composite material.

Such a filamentary arrangement obviates the aforesaid problems inherent in conventional three dimensional filament-reinforced composite materials.

In the textile or filamentary structure according to the invention, although the filament ends appear or are exposed at the start and end points of filament disposition, there is no cut, free or exposed filament end at each turn, fold or convolution. Therefore, the textile or filamentary structure exhibits satisfactory shape-retention capability, even without special filament end treatment and may be used as it is, with no danger of filaments disengaging, dislodging or breaking free from the body of material during any subsequent matrix impregnation process. Moreover since the filaments constituting the textile or filamentary structure maintain a high filament content, or density the reinforcing effect on the final product can be maintained at an extremely high level, as compared with known three-dimensional woven fabrics.

Furthermore, the present invention is advantageous in that the densely interlaced filaments provide a dense structure and since each filament remains straight within the textile structure, the strength of the raw filament material is utilized to the full and delamination is prevented; and the textile structure can be formed in various complicated shapes (as illustrated in the drawings) direct, and in closer conformity with the desired end-product shape, thereby reducing the need for subsequent finish-shape machining and overall imparting design flexibility.

PREFERRED EMBODIMENT OF THE INVENTION

Figure 1:
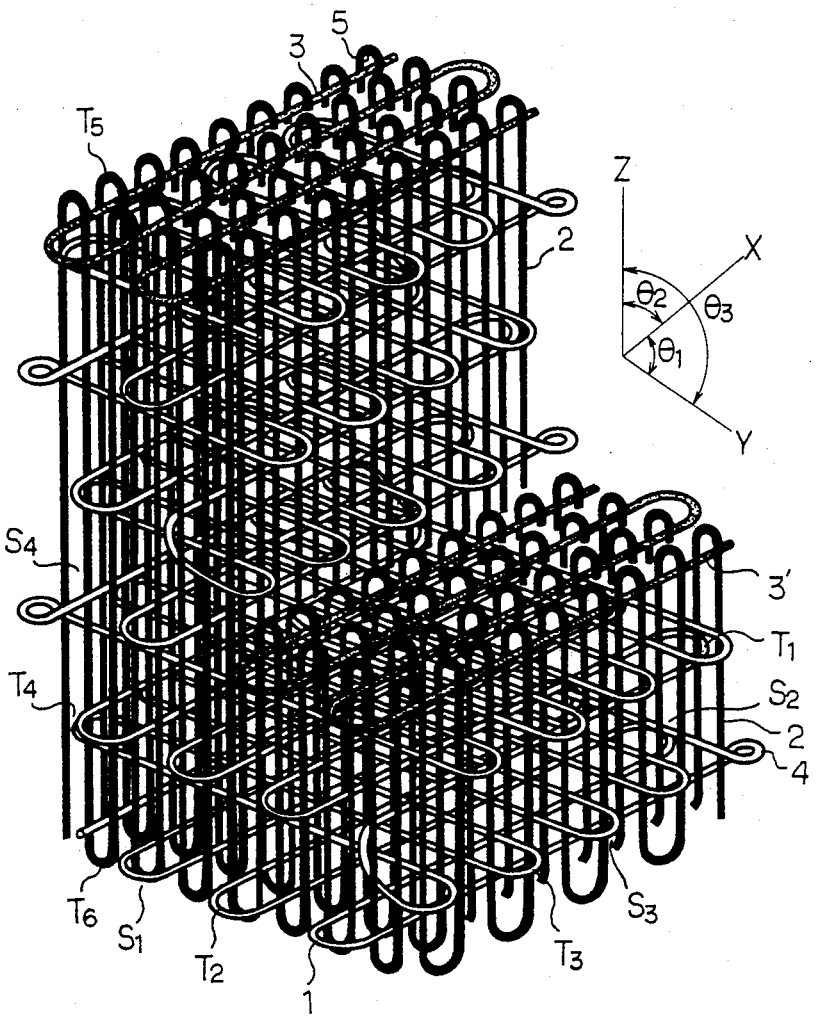
FIG. 1 is an enlarged perspective view illustrating diagrammatically an example of a textile or filamentary structure for a reinforced composite material according to the invention.

Referring to the drawings, in FIG. 1, a textile or filamentary structure having three filament array axes X, Y and Z, intersecting at predetermined relative crossing angles 01, 02 and 03, is formed of three differently-disposed filaments or filament runs. Thus, the textile or filamentary structure shown in this embodiment comprises a first filament 1 extending from a first end surface S1, in the direction of a first filament-disposition axis (X-axis), to a second end surface S2 opposite to the first end surface S1, to form a first turn T1 on the second end surface, turning around one or two or more courses or runs of a second filament 2 and extending back to the first end surface S1, to form a second turn T2 on the first end surface, and again turning around one or two or more courses of the second filament 2 and extending again to the second end surface S2, thereafter repeating the turn-around path or convolution until it reaches a terminal end 4 of a first filament-disposition plane, at which terminal end it curves in the Y-axis direction, different from the preceding direction of filament disposition, to move to a second filament-disposition plane, parallel to the first filament-disposition plane, but forming a crossing angle of 90° with the general path of filament disposition prior to arrival at the terminal end 4 of the first filament-disposition plane, thereafter repeating the convoluted turn-around path, while forming third and fourth end surfaces S3 and S4, respectively, until it forms a second filament-disposition plane, in which it turns around one or two or more courses of the second filament 2 at the third and fourth turns T3 and T4, whereater it repeats the convoluted turn-around path in the first and second filament-disposition planes, the second filament 2 extending in one direction (Z-axis direction) so as to be orthogonal to the first and second filament-disposition planes, thereby to form a third filament-disposition plane, in which it spans the first filament 1 at its turns T5 and T6, whereafter its repeated convolutions form the third filament-disposition plane, and a third filament 3 which extends through upper loops 5 formed of the second filament 2 at the turns T5 for the second filament 2, to form a fourth filament-disposition plane. The second filament, which is disposed in the third filament-disposition plane, also serves to tighten the lamination of the first filament 1.

In the present invention, the filaments 1, 2 and 3 forming the textile or filamentary structure may be suitably selected, in accordance with the desired characteristics of the final product, from the class consisting of such inorganic fibres as glass fibre, carbon or graphite fibre, silicon carbide fibre and alumina fibre, and such synthetic fibres as polyester fibre, aliphatic or aromatic fibre (for example, the heat resistant fibre, KEVLOR or NOMEX, by Du Pont). For example, if the finally obtained composite material is a rocket nose cone, a part for brake devices subjected to a high instantaneous load, such as vehicle brake devices for aircraft and Shinkansen Express Railway Line, or a mechanical part requiring heat resistance and wear resistance, such as a current collector for electric cars, then it is desirable to use carbon fibre or graphite fibre for the filaments 1, 2 and 3. These filaments are formed into a textile or filamentary structure having a high filament content or density in accordance with the procedure described above, the textile or filamentary structure then being impregnated with a thermosetting resin, such as epoxy resin or phenol resin, to be moulded into a desired shape, and through curing and machining it is finished into a final product. However, in a use requiring higher heat resistance, it is possible to use carbon as the matrix.

It is also possible to incorporate carbon powder or the like in the thermosetting resin as a second reinforcing component. Furthermore, the textile or filamentary structure according to the invention may be used as it is, even without being impregnated with thermosetting resin, to constitute a packing material of complicated shape, a shock absorbing material or a filler.

In the embodiment shown in FIG. 1, the first, second and third filaments, with the directions of filament axes crossing each other at right angles, are each formed of carbon fibre, but are differently marked to facilitate the understanding thereof. Thus, the first filament 1 is shown as a white continuous filament, the second filament 2 as a black continuous filament and the third filament 3 as a shaded continuous filament. The first and second filaments 1 and 2 form the basic textile or filamentary structure in accordance with the aforesaid procedure, while the third filament 3 functions as a locking member, or a latch, for preventing filaments from coming undone or breaking loose from the end surface of the multi-layer or laminated core structure of the filaments 1 and 2. As for the arrangement of these filaments 1, 2 and 3, it is preferable to minimize the spacing of the filaments 1 and 2, so that the associated textile or filamentary structure may have a high filament content.

Figure 7:
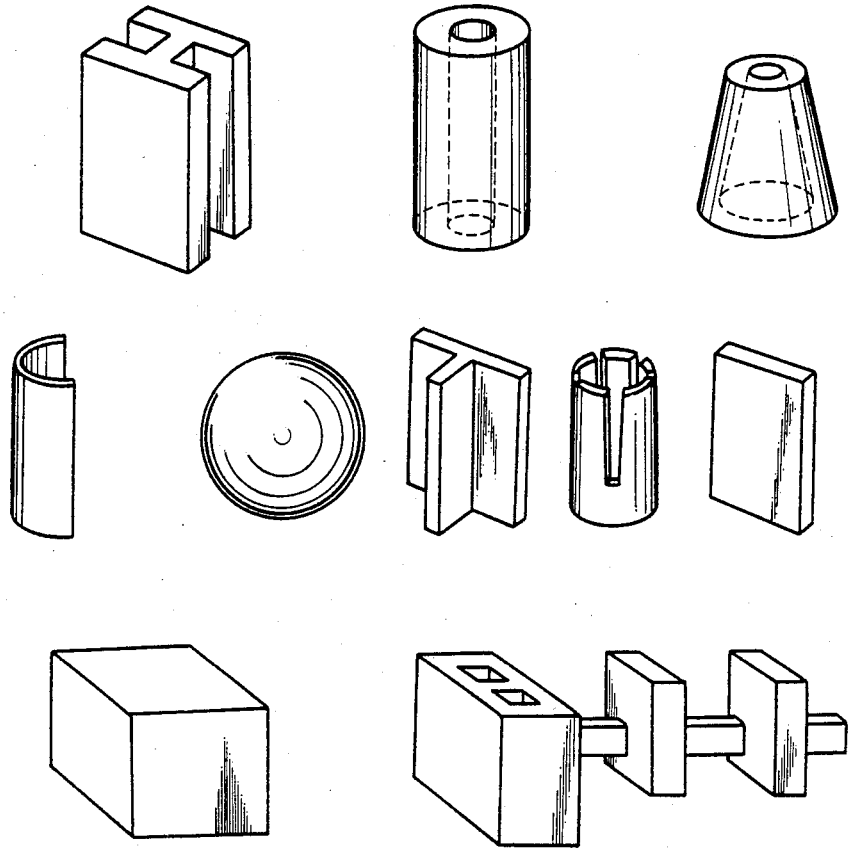
FIG. 7 shows by way of example the respective shapes of composite materials, using textile structures according to the invention as reinforcing members.

In the above embodiment, the intersection angles $\theta 1$, $\theta 2$ and $\theta 3$ are each set at 90°, so that the axial directions of the first, second and third filaments 1, 2 and 3 intersect at right angles, but the essence of the invention is not limited to such an example. Thus, any desired filament intersection angle, such as 75° or 60°, may be selected in accordance with the characteristics of the load acting on the composite material or in accordance with the shape of the textile or filamentary structure. Furthermore, there is not special restriction on the shape and size of the final product, so long as the aforesaid arrangment is adopted; the reinforcing performance can be achieved in connection with composite material having, for example, a cylindrical cross-sectional shape or profile cross-sections including H-shape, U-shape and so on shown in FIG. 7.

Figures 2, 8, 9:
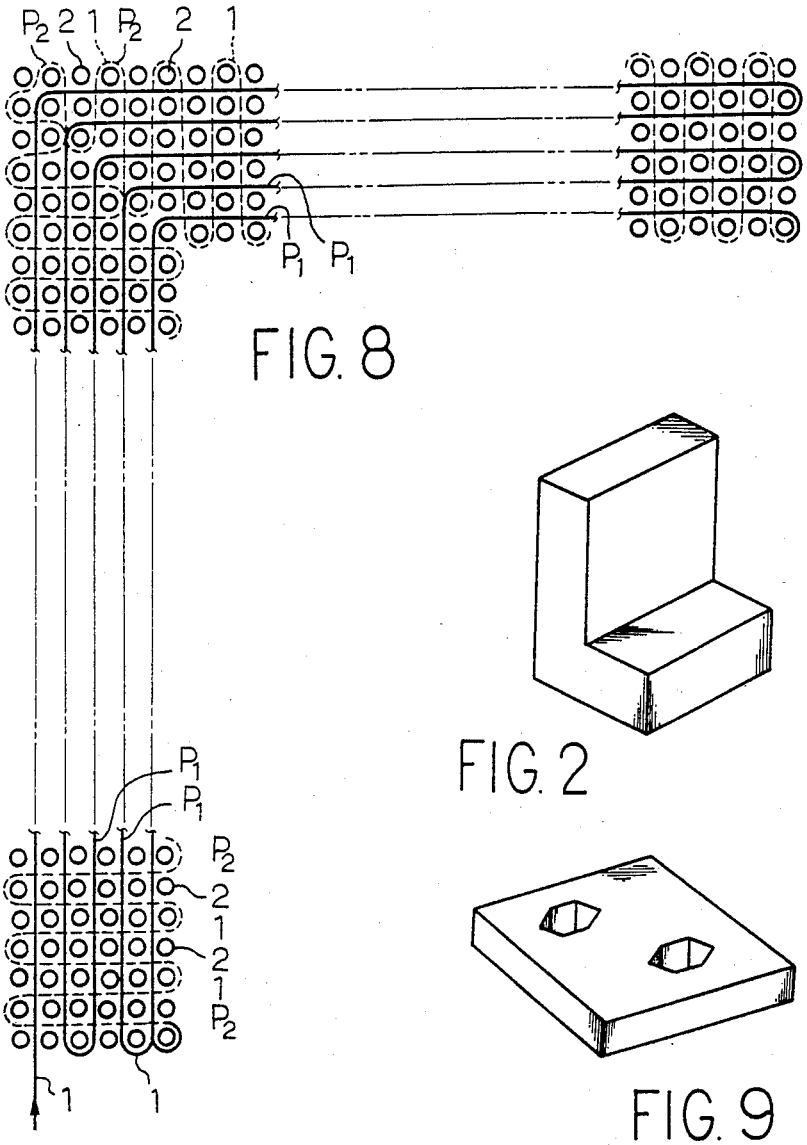
FIG. 2 is a perspective view of an L-shaped composite material using the textile or filamentary structure of FIG. 1 as a reinforcing material.
FIG. 8 is a plan view of a textile or filamentary structure showing another embodiment of the invention, employing a different method of filament disposition from that used in the embodiment shown in FIG. 1.
FIG. 9 is a perspective view showing a structure in the form of an apertured plate.

In producing a reinforced L-shaped textile or filamentary structure as shown in FIG. 2, it is possible to employ a method of filament disposition shown in FIG. 8 as an alternative method, in order to increase the strength of the inside corner portion of the structure. That is, in this embodiment, the first filament 1 lies in a single plane folded or bent in an L-shape and repeats a zigzag or convoluted path along the bent shape to form first filament-disposition planes P1, whereupon it repeats a zigzag path in a direction approximately orthogonal to the direction of filament progression in the first filament-disposition planes, so as to form second filament-disposition planes P2 above the first filament-disposition planes P1. Thereafter, the formation of the filament-disposition planes P3 through Pn by the first filament in accordance with the same procedure is repeated a predetermined number of times. On the other hand, the second filament 2 repeats a convoluted or zigzag travel in a path orthgonal to the filament-dispositional planes P1 through Pn of the first filament 1, in accordance with the same procedure as shown in the embodiment in FIG. 1. In this manner, a textile or filamentary structure having the strength of the inside corner portion thereof increased, is formed of the first filament 1, the second filament 2 and the third filament (not shown).

In the foregoing embodiments, the first filament 1 has been shown as a single continuous filament. However, in the case of a textile or filamentary structure of complicated shape, two or more filaments having no exposed or cut end at each turn may be used together as the first filaments. Further, it is not necessary for the first and second filaments 1 and 2 to be free of any knot or join throughout their length; thus, a plurality of filaments may be joined together by known methods, such as bonding, fusion and knotting, so long as the cut or exposed ends are not positioned at the turns, in forming a textile structure.

Figure 3:
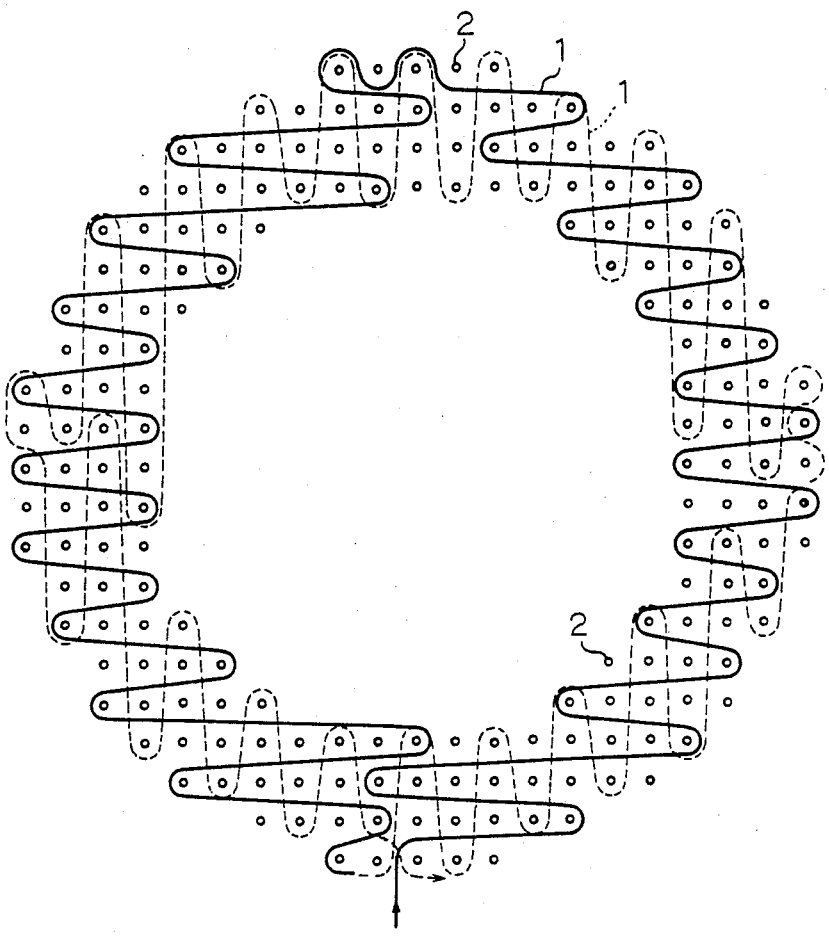
FIGS. 3 to 5 illustrate diagrammatically how filaments are disposed in a textile or filamentary structure when the composite material is an apertured cylindrical body.
Figure 4:
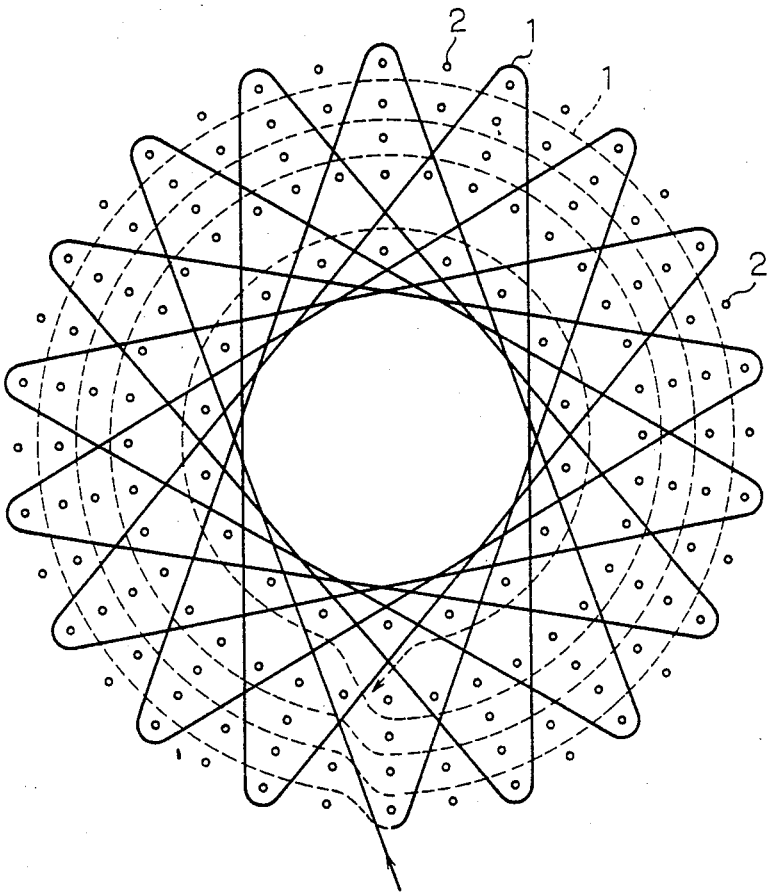
Figure 5:
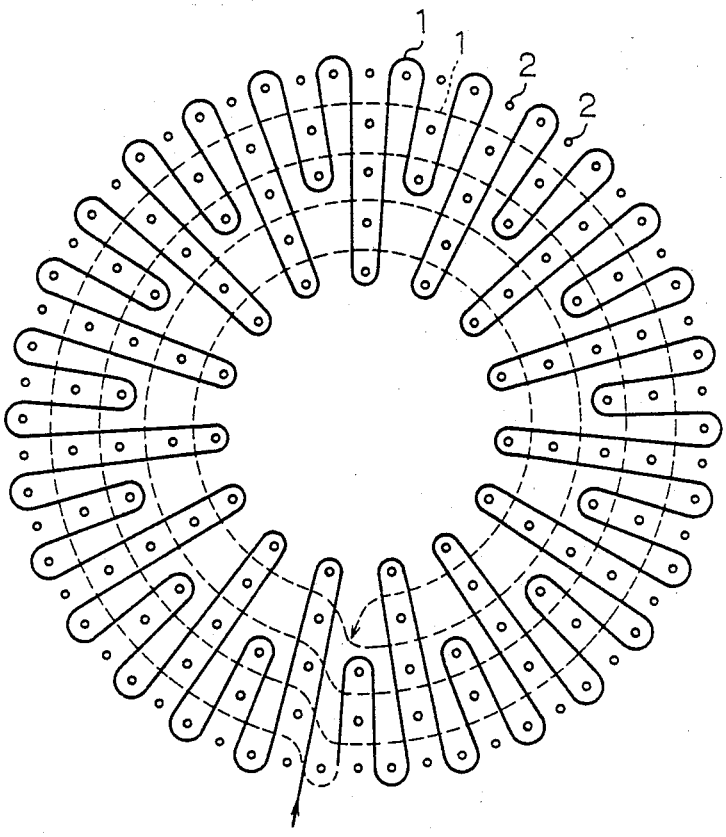
Figure 6:
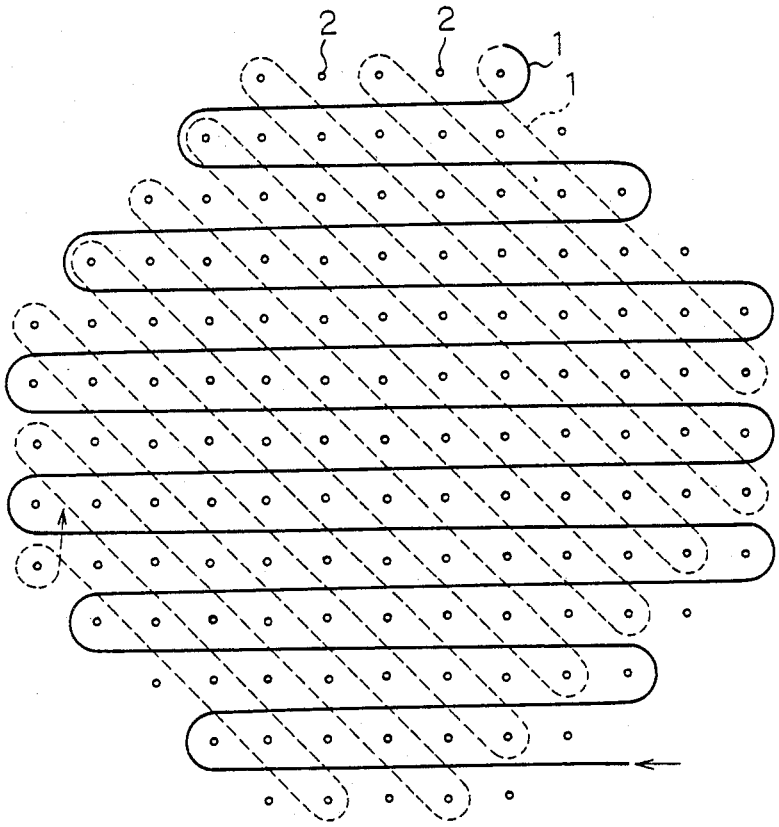
FIG. 6 depicts diagrammatically how filaments are disposed when the composite material is an octagonal prism body.

FIGS. 3 through 5 are explanatory views showing how the filaments 1 and 2 are disposed in the case where the composite material is an apertured cylindrical body, and FIG. 6 is an explanatory view showing how the filaments are disposed in the case where the composite material is an octagonal prism body.

FIG. 9 shows a structure in the form of an apertured plate. In forming such apertured plate by the conventional method, an unapertured block is moulded, impregnated with resin and subjected to a desired aperturing or punching operation using a cutting tool such as a drill; by which method, however, the component filaments of the reinforcing textile structure are liable to be cut or frayed. Further, the tool life is shortened. In the present invention, since the aperture can be formed simultaneously with the formation of the textile or filamentary structure, the decrease in the strength of the structural material due to the cutting of filaments, which has been a problem in the conventional method, can be effectively avoided.

The textile or filamentary structure according to the present invention can be used as a composite material for machines and equipment requiring strength, heat resistance, and abrasion resistance, such as space projectiles, aricraft, automobiles, railroad vehicles and ships, or as a building member. Further, excellent inelasticity can also be available when it is used for, say, the face insert of a golf club.

What is claimed is:

1. A textile or filamentary structure for a reinforced composite material comprising a filament 1 which is disposed in a first filament-disposition plane in multiple turns or convolutions without forming a cut, free or exposed end at any turn and is disposed in a second filament-disposition plane parallel to and above or below the first filament-disposition plane, the path of the filament in the first filament-disposition plane being different from the path of the filament 1 in said second filament-disposition plane, whereafter the filament is disposed in additional first and second filament-disposition planes; a filament 2 extending sinuously between the paths of the filament 1 in said first and second filament-disposition planes to form successive planes which intersect said first and second filament-disposition planes, without forming a cut, free or exposed end at any turn; and a filament 3 sinuously extending through loops formed by said filament 2, thereby retaining the same in the body of the structure.

2. The filamentary reinforcement of claim 1, the filamentary material of which is an inorganic fiber.

3. The filamentary reinforcement of claim 2, wherein the inorganic fiber is selected from the group consisting of glass fiber, carbon fiber, graphite fiber, silicon carbide fiber and alumina fiber.

4. The filamentary reinforcement of claim 2, wherein the inorganic fiber is carbon fiber.

5. The filamentary reinforcement of claim 1, the filamentary material of which is a synthetic fiber.

6. The filamentary reinforcement of claim 5, wherein the synthetic fiber is selected from the group consisting of polyester, aliphatic and aromatic compounds.

7. The filamentary reinforcement of claim 5, wherein the synthetic fiber is an aromatic polyamide.

8. The filamentary reinforcement of claim 2, which has been impregnated with a thermosetting resin.

9. The filamentary reinforcement of claim 3 which has been impregnated with a thermosetting resin.

10. The filamentary reinforcement of claim 4, which has been impregnated with a thermosetting resin.

11. The filamentary reinforcement of claim 2, which has been impregnated with a thermosetting resin containing carbon powder.

12. The filamentary reinforcement of claim 3, which has been impregnated with a thermosetting resin containing carbon powder.

13. The filamentary reinforcement of claim 4, which has been impregnated with a thermosetting resin containing carbon powder.

14. The textile or filamentary structure of claim 1 wherein said first filament-disposition plane is orthogonal to its path in said second filament-disposition plane.

15. The textile or filamentary structure of claim 1 wherein the paths of said filament 2 are parallel.

16. The textile or filamentary structure of claim 1 wherein the textile or filamentary structure is reinforced by a thermoplastic resin.

* * * * *